US005182880A

United States Patent [19]

Berge, Jr. et al.

[11] Patent Number: 5,182,880

[45] Date of Patent: Feb. 2, 1993

[54] DOOR FRAME CLADDING APPARATUS

[75] Inventors: Richard H. Berge, Jr., Faribault; Mark A. Larsen, Excelsior, both of Minn.

[73] Assignee: New Morning Windows, Inc., Burnsville, Minn.

[21] Appl. No.: 793,201

[22] Filed: Nov. 18, 1991

[51] Int. Cl.[5] ..... E06B 1/04; E06B 3/30

[52] U.S. Cl. ..... 49/504; 49/460; 52/211

[58] Field of Search ..... 49/504, 505, 460, 462; 52/211, 212, 213, 214, 215, 204

[56] References Cited

U.S. PATENT DOCUMENTS

| | | | |
|---|---|---|---|
| 3,130,455 | 4/1964 | Borlenghi | 52/211 X |
| 3,340,665 | 9/1967 | Kohl | 52/204 X |
| 3,662,494 | 5/1972 | Sitterly | 49/504 |
| 4,122,633 | 10/1978 | Holdiman | 49/504 X |
| 4,594,812 | 6/1986 | Clancy et al. | 49/504 X |
| 5,058,323 | 10/1991 | Gerritsen | 49/504 |

*Primary Examiner*—Philip C. Kannan
*Attorney, Agent, or Firm*—Donald A. Jacobson

[57] ABSTRACT

This apparatus uses cladding to cover the inner surfaces of a door frame. The cladding also overlaps the door nose and its mounting screws. Two-sided adhesive tape on one edge of the cladding attaches the cladding to the door nose. The cladding has a perpendicular integral fin which extends into an opposed mating slit parallel to the door frame edge in the door frame inner surface. This combination aligns the cladding parallel to the door frame and holds theh cladding in place against tangential forces. An outwardly extending groove from the edge of the door frame opposite the door nose and parallel to the edge terminates in a keyway. The edge of the cladding opposite the nose has an perpendicular inset, which is sized to fit within the groove in the door frame. The inset terminates in an inwardly directed projecting key. The end of this key is pointed to engage the door frame keyway to hold that edge of the cladding securely in place.

2 Claims, 2 Drawing Sheets

DOOR FRAME CLADDING APPARATUS

FIELD OF THE INVENTION

This invention relates to a metal door cladding which cooperates with a prepared door frame to cover the frame with no metal fasteners being required for installation.

BACKGROUND OF THE INVENTION

There are a number of door cladding or metallic door casing inventions. In Noach, U.S. Pat. No. 4,793,109; a profiled steel door jamb is attached over a facing wooden door frame using screws which can only be inserted the desired distance for correct positioning. In Kuffner, U.S. Pat. No. 4,179,849; a door frame assembly is made of first and second aluminum extrusions which can be placed in a door opening after the wall is finished. The assembly is attached to steel anchor plates fastened to the wall in the door frame opening. In Williams, U.S. Pat. No. 4,126,975; a metal door jamb of two piece overlapped constructions are secured together by a screw and clamp portion. In Kirton, U.S. Pat. No. 3,881,279; elongated members transversely slideably adjustable provide a variable width to a door frame. In Lehman, U.S. Pat. No. 3,654,734; pre-assembled U-shaped members, which include assembly plates, are secured together by fastening elements. In Pond, U.S. Pat. No. 3,520,085; an adjustable door frame uses side jamb and head jamb combinations consisting of two overlapping and contiguous members for walls of various thickness. In Cline, U.S. Pat. No. 3,420,003; an adjustable door frame for varying wall thickness uses a plurality of backing plates along an edge of the wall opening having a series of ratchet teeth to engage a gripping edge on the trim strips. In Mascari, U.S. Pat. No. 2,860,744; an adjustable door frame uses overlapping parts and ratchet engagement means. In Philip, U.S. Pat. No. 2,454,523; a door frame casement uses telescopic engagement to another part to accommodate different widths. In Thye, U.S. Pat. No. 1,715,579; a pair of cooperating members mounted on opposite sides of a wall overlap to provide coverage.

All of these approaches utilize a variety of structures and fastening means to cover a door frame whereas the instant invention uses only the generally planar cladding itself to provide similar results.

SUMMARY OF THE INVENTION

This invention provides a simple attachment means requiring only a double-sided tape and matching recesses in the door frame to align, attach and seal metal cladding to that portion of the inner surface of a wood or plastic door frame exposed to weather. This cladding provides mechanical protection, a weatherproof seal and a decorative appearance. A separate cladding segment is attached to each of the two inner sides and to the upper inner surface of the door frame. The cladding is attached to the inner surface of a door frame after the door frame has been installed in a building.

The door frame is usually prepared during manufacture by providing a mating keyway, groove and slit during manufacture for the installation of this cladding protection, however this preparation ca be performed at the construction site. The door frame can be out of plumb without affecting the cladding installation.

The door frame and a metal door nose previously installed along the outside edge of the door frame are normally both utilized in the installation of the cladding. The cladding is sized to cover the inner surface of a door frame extending from the inner edge of the door frame opposite the door nose to extend outward and partially overlap the door nose. The cladding surface is generally planar and sized to overlap and conceal any screws used to mount the nose in place. That portion of the cladding which extends over the nose is offset to accommodate the thickness of the door nose. During the cladding manufacture double-sided adhesive tape is placed along the portion of the cladding which overlaps the door nose. This tape both attaches the cladding to the door nose and provides a seal against the weather. This double-sided adhesive tap has a protective layer of tape over its exposed adhesive surface. This protective tape is removed just before the cladding is installed. While this cladding is normally used with a door nose, the offset for the door nose thickness can be omitted and adhesive applied directly to the door frame itself.

The cladding has a integral fin which extends perpendicularly from the under surface, as installed. This fin is installed parallel to the edge of the door frame. The fin extends into a matching slit in the door frame prepared in the door frame before the installation of the cladding. This rib aligns the cladding with the edge of the door frame along the major dimension and prevents movement of the cladding over the door frame.

A short inset extends perpendicularly from the surface of the cladding on the edge which is installed opposite to the door nose. This perpendicular inset fits into a mating groove along the side of the door frame adjacent to the edge. The inset terminates in a sharp pointed key which is directed inward towards the door frame, which fits into a keyway in the door frame which adjoins and communicates with the groove. The groove and keyway are prepared in the door frame prior to installation. The cladding is installed with the sharp key projection extending into the keyway in the door frame which secures the edge of the cladding opposite the nose to the door frame.

The cladding is cut to the necessary length to cover a surface of the door frame and the protective tape removed from the cladding prior to its installation. The cladding is then installed by hooking the sharp key into the keyway on the edge of the door frame opposite the nose, and then rotating the cladding until the perpendicular fin is positioned within the longitudinal slit in the inner surface of the door frame. When the fin is fully inserted into this slit, the exposed adhesive tape will be placed in contact with the surface of the door nose along the inner surface of the door frame. This adhesive tape attaches and seals the cladding to the door nose to complete the installation.

DETAILED DESCRIPTION OF PREFERRED EMBODIMENT

Figure 1:
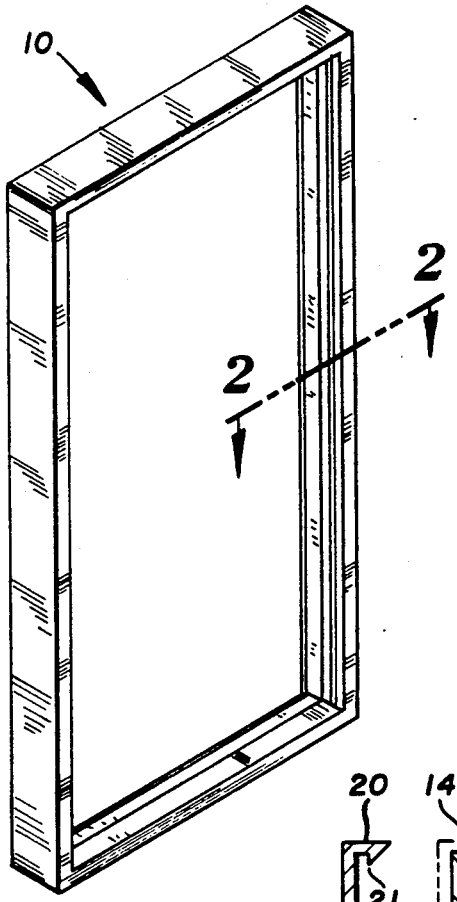
FIG. 1 is an isometric view of the door frame covered with cladding.
Figure 2:
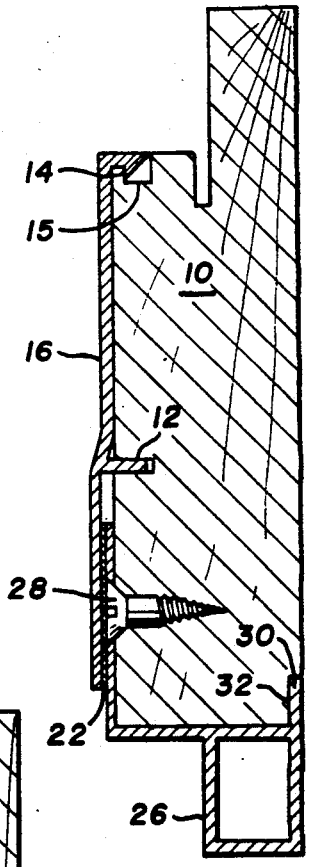
FIG. 2 is a cross-section view taken along 2—2 from FIG. 1 showing the attached cladding.
Figure 3A:
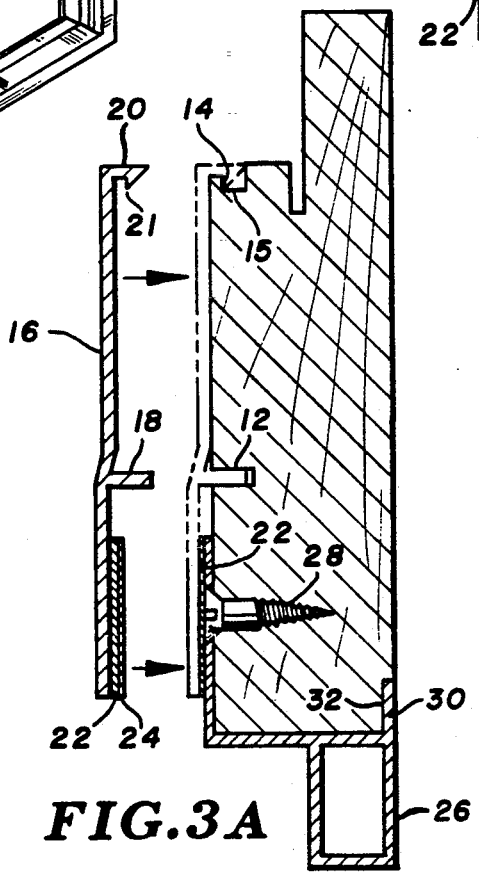
FIG. 3A is a cross-section view taken along 2—2 from FIG. 1 showing the cladding in solid outline before attachment and in dashed outline after attachment.

A wooden door frame 10 is shown in FIG. 1 with cladding attached to the inner surface. Frame 10 and cladding 16 are also shown in FIGS. 2 and 3A. Door frame 10 has been prepared by cutting slit 12, parallel to the edge of the frame into the inner surface of door frame 10. Groove 14 and interconnected keyway 15 are cut into the side of the door frame extending from the corner outward. Cladding 16 is formed from a sheet of material with an integral projecting fin 18 extending perpendicular to the surface of the sheet, and with a projecting inset 20 extending perpendicular to the sheet along one edge. Inset 20 terminates in an inwardly directed sharp projection which forms key 21. Inset 20 is sized to fit within groove 14, and key 21 is sized to fit within and engage keyway 15.

Figure 3B:
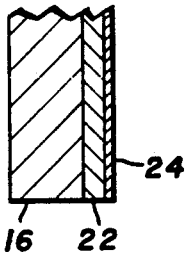
FIG. 3B is a detail of the cladding showing the tape and protective tape cover.

Tape 22 is attached along the opposite edge of cladding 16 and on the side of the sheet which is installed facing door frame 10. Tape 22 has an adhesive on both sides. Tape 22 is installed on cladding 16 by the adhesive on one side during manufacture. The opposite side of tape 22 has a protective tape 24, shown in cross-section in FIG. 3B, to protect the adhesive before installation. The portion of cladding 16 which extends over nose 26 is offset from projection 18 to the edge covering the nose to accommodate the thickness of the nose, as shown in FIGS. 2 and 3.

As shown in FIGS. 2 and 3A, door nose 26 is fastened to the side of the door frame 10 opposite the edge containing groove 14 and keyway 15 by wood screw 28. Wood screw 28 is inserted through a hole in the door nose into door frame 10 to secure the door nose in place. A projection 30, extending from a corner of nose 26, fits within a groove 32 in the corner of door frame 16, sized to mate with the door nose projection.

Cladding 16 is installed on all three inner sides of door frame 10, excepting the threshold of the door frame which is treated in a different manner and not covered by cladding. A length of cladding 16 is first cut to the length required to cover one side. After cladding 16 is cut to length the protective tape 24, as shown in FIG. 3A, is removed before the cladding is installed.

Key 21 of cladding 16 is then hooked into keyway 15 and the cladding rotated until projection 18 is inserted into slit 12 with tape 22 pressed against nose 26, as shown in FIG. 2 and in dashed outline in FIG. 3A. Pressing tape 22 against nose 26 will secure cladding 16 in place, and also provide a weatherproof seal between the cladding and the nose. This process is repeated for all the three inner sides of door frame 10.

Figure 4:
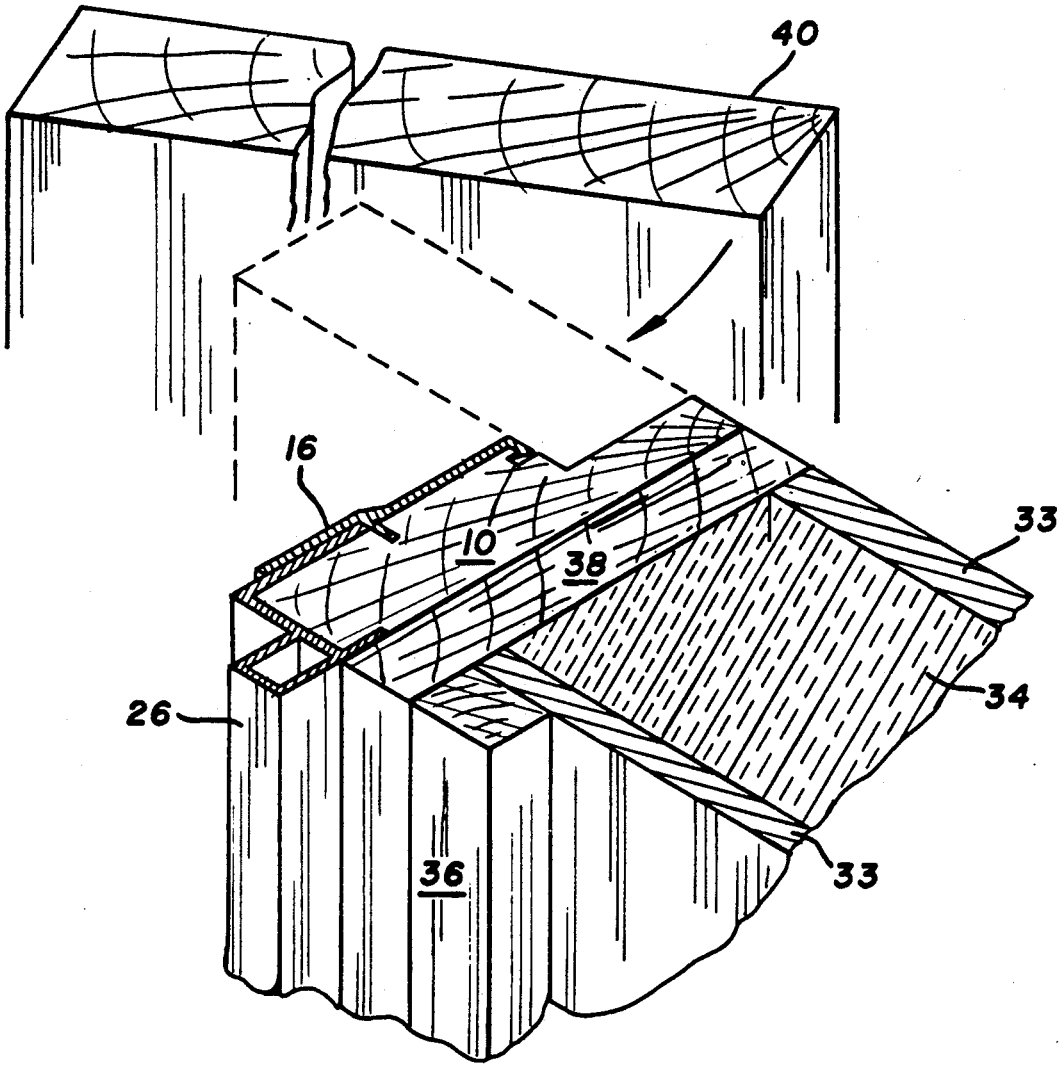
FIG. 4 is a cross-section of the door frame and adjoining wall with an adjacent door shown open in solid outline and closed in dashed outline.

In FIG. 4, another perspective of cladding 16 as installed on door frame 10 is shown to show the relationship between the various building parts and the cladding. Walls 33, which enclose insulation 34, have a trim board 36 mount®d on the outside with door joist 38 beside them. Door frame 10 is attached to door joist 40 and door nose 26 is attached to the outer edge of the door frame. Cladding 16 covers the exposed inner surface of door frame 10 and overlaps a portion of door nose 26. Door 40 swings against the inside of door frame 10, as shown, being hinged on the opposite end, not shown. The only exposed portion of door frame 10 which is not covered by cladding 16 or door nose 26 is on the inside adjacent to door 40, where it is not exposed to outside weather conditions.

This invention provides a rugged, decorative surface over a wooden or plastic door frame with a minimum of parts and complexity both in the apparatus itself and in its installation. No more material is used than is absolutely necessary to accomplish the purpose and no separate parts for alignment are necessary. Since this cladding can be used with a door nose, that edge of the door frame is covered by the door nose itself, therefore no covering is required on that edge. The extending edge opposite to the door nose, which is not exposed to weather, has only the corner covered. This extending edge also provides an attachment means for the inside edge of the cladding. Lapping the cladding over the door nose to cover any screws used to attach the door nose to the door frame also enhances the appearance of the door nose.

The perpendicular fin from the cladding, which extends from the cladding surface into the slit in the surface of the door frame, not only aligns the cladding with the door frame, but also prevents the cladding from being displaced relative to the door frame by outside forces acting on the cladding. This fin thus provides both alignment and resistance to relative movement in a simple manner.

The cladding is easy to install and only requires tools in cutting the cladding to the proper length. After that no other tools of any kind are required for installation. The sharp projection of the key into the keyway in the edge of the door frame used to hold the opposite side of the cladding to the door frame is also a simple but an effective attachment means which provides all of the necessary strength required to hold to cladding to the door frame edge with no additional parts being required.

The double-sided adhesive tape provides not only a simple attachment means, which requires no tools to implement, but also provides a weatherproofing seal the full length of the cladding between the door nose and the cladding. Since this portion is exposed to outside weather conditions this seal is important but is the only one required.

The cladding does not have to be used with a door nose since the adhesive could secure the cladding directly to the door frame. The cladding in this case would not have an offset to provide for the thickness of the nose. The cladding can be made of a number of types of metal and could also be made of plastic. The adhesive could simply be applied to the surface of the cladding or the door frame before installation rather than as shown here. The door nose shown is merely representative and can be any type of door nose used in the trade.

This invention provides a complete solution to the problem of covering the portions of a door frame which are exposed to outside weather conditions. The invention is simple, effective, takes advantage of other door parts and also provides a decorative effect.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

We claim:

1. Cladding apparatus for covering a generally U-shaped opening in the outer wall of a structure, the door frame having inner surfaces about and perpendicular to the opening which is sized to receive a door, the door frame also having adjoining inner and outer surfaces which are perpendicular to the inner surface, the outer surface having a door nose which cover the entire surface, the door frame being prepared by having slits in the inner surfaces which are parallel to the adjoining inner and outer surfaces and extend inward perpendicular to the doorway inner surface, having keyways in the adjoining inner surfaces which are parallel to the inner surfaces and extend inward perpendicular to the adjoining inner surface, and having grooves in the adjoining inner surfaces which extend parallel to the inner surface from the inner surface to the keyway, the cladding apparatus comprising a rectangular sheet of rigid material having an inset of a predetermined length and width which extends from an edge of said sheet perpendicular to said sheet in a first direction, said inset terminating in a key means for engaging a keyway, the sheet also having a fin of a predetermined length and width extending in the first direction perpendicular to the surface of said sheet, the dimensions and spacing of said inset said fin and the arrangement of said key means being such that said sheet will cover the inner surface of the door frame and a predetermined portion of the door nose with the insert fitting within the groove in the adjoining inner surface, with the key means engaging the keyway in the adjoining inner surface, and with the fin engaging the slit in the inner surface.

2. Apparatus as in claim 1 and further having adhesive means for attaching the sheet to the door nose.

* * * * *